United States Patent [19]

Shuler

[11] Patent Number: 4,788,839

[45] Date of Patent: Dec. 6, 1988

[54] TAMPER RESISTANT LOCK BOLT ASSEMBLY

[75] Inventor: Eugene L. Shuler, Mount Prospect, Ill.

[73] Assignee: Chapman Industries Corp., Elk Grove Village, Ill.

[21] Appl. No.: 466,975

[22] Filed: Feb. 16, 1983

[51] Int. Cl.[4] ..... E05B 55/00

[52] U.S. Cl. ..... 70/143; 70/416; 292/341.13

[58] Field of Search ..... 70/360, 361, 416, 418, 70/143, 240, 241, DIG. 20, DIG. 27, DIG. 36; 292/137, 163, 175, 145, 169, 74, 2, 346, 150, 341.13

[56] References Cited

U.S. PATENT DOCUMENTS

| | | | |
|---|---|---|---|
| 1,367,822 | 2/1921 | Lindsay | 292/175 |
| 3,473,834 | 10/1969 | Lehmann | 292/341.13 |
| 3,659,444 | 5/1972 | Wellekens | 70/360 |
| 4,083,211 | 4/1978 | Scherbing | 70/363 |
| 4,380,915 | 4/1983 | Kincaid et al. | 70/DIG. 20 |

FOREIGN PATENT DOCUMENTS

| | | | |
|---|---|---|---|
| 2651038 | 5/1978 | Fed. Rep. of Germany | 70/240 |
| 148802 | 6/1981 | German Democratic Rep. | 70/240 |

*Primary Examiner*—Robert L. Wolfe

*Attorney, Agent, or Firm*—Marshall, O'Toole, Gerstein, Murray & Bicknell

[57] ABSTRACT

A tamper-resistant, reciprocating cylinder lock comprising a bolt and a bolt keeper having the capacity to prevent dislodgement of the bolt from engagement in its locked position with the keeper when the lock and keeper mechanism are under physical attack.

2 Claims, 1 Drawing Sheet

TAMPER RESISTANT LOCK BOLT ASSEMBLY

BACKGROUND

The present invention relates generally to an improved tamper-resistant, reciprocating cylinder lock and lock bolt keeper mechanism. The apparatus of the present invention provides structure for reducing the likelihood of dislodgement of the bolt from a locked position when the lock mechanism is under physical attack.

Conventional, non-reciprocating cylinder locks are typically fixedly mounted to a solid surface, secured against any movement other than rotational movement of the lock cylinder upon insertion of the proper key (e.g., a door lock mounted in a mortise). Reciprocating cylinder locks, in contrast, are designed to permit longitudinal movement of the entire lock mechanism as well as key-actuated rotational movement of the lock cylinder. Reciprocating cylinder locks have a variety of common uses, including vending machines, bicycle shackles, and automobile security devices, for example.

A reciprocating cylinder lock is conventionally mounted within a casing having inner and outer ends, the form of which is determined by the particular use of the lock. A longitudinal passage in the casing defines a cylindrical lock chamber and permits insertion of a protective tubular sleeve inside the chamber. The tubular sleeve has inner and outer ends and a cavity or opening therein extending transverse to the axis of the sleeve. The sleeve is mounted for axial movement between a retracted locked position and an extended unlocked position, and the sleeve is normally urged toward its extended position. A bolt is mounted for movement through the sleeve cavity along a linear path transverse to the axis of the sleeve between a retracted, unlocked position and an extended, locked position. The bolt is normally urged toward the extended, locked position.

Also part of the lock mechanism are a bolt keeper for engaging the bolt when the bolt is in its extended position and a rotatable locking shaft within the sleeve having inner and outer ends. The locking shaft includes structure responsive to rotation of the shaft for retracting the bolt from its extended, locked position. The outer ends of both sleeve and lock shaft are designed for insertion of a key.

In an unlocked condition, a portion of the sleeve-encased lock shaft will extend longitudinally outward from the outer end of the casing. The reciprocating cylinder lock can be moved to a locked position by depressing the longitudinally-extending portion of the sleeve-encased shaft until it is flush with the outer end of the casing. This inward axial movement of the lock shaft aligns the spring-biased bolt with a casing cavity adjacent to the keeper. In this position the bolt spring urges the bolt toward the casing cavity, and brings the bolt into engagement with the lock bolt keeper. A major advantage of such reciprocating devices is that no key is required to place the device in a locked position.

It has been found that conventional reciprocating cylinder locks, particularly those in which the spring-biased bolt extends vertically upward from the lock mechanism, can be defeated by physical attack on the lock mechanism itself. Repeated hammering on the lock with any implement which can convey a force can cooperate with the normal force of gravity to dislodge the bolt from engagement with the bolt keeper and force the bolt more fully into the sleeve cavity, which permits the sleeve to be returned to its unlocked position. In a like manner, tampering can also be effective in dislodging reciprocating cylinder locks in which the bolt is not in an upright position, depending on the strength with which the lock is repeatedly hit with an instrument, such as a hammer.

An example of a reciprocating cylinder lock which would be susceptible to such tampering, is described in Scherbing, U.S. Pat. No. 4,083,211. A reciprocating cylinder lock is at particular risk when incorporated into a mechanism such as an anti-theft automobile security device. This is because of the frequency with which auto thefts are attempted and the persistency with which a car thief will tamper with an individual anti-theft device.

There exists, therefore, a need in the art of locking mechanisms for a reciprocating cylinder lock which is resistant to dislodgement by common forms of physical tampering, such as hammering.

SUMMARY

The apparatus of the present invention provides a lock with improved capacity to resist physical tampering. More particularly, the present invention provides a reciprocating cylinder lock mechanism which can be utilized with effect in a variety of ways. The improved lock mechanism of the present invention is particularly useful in applications wherein the lock is mounted so that the spring-biased bolt extends vertically upward from the lock mechanism.

Modified surfaces on the bolt and the keeper of the lock mechanism of the present invention cooperate to increase the resistance of the bolt to dislodgement from its extended, locked position by physical tampering with the lock mechanism. More particularly, there are mutually engageable, inclined surfaces on the bolt and the keeper disposed in non-parallel relation to the linear path of movement of the bolt. The engageable surface of the bolt is inclined toward the outer end of the sleeve, and the engageable surface of the keeper is parallel to the engageable surface on the bolt and underlaps the bolt.

The inclined engagement of the engageable surfaces of the bolt and the bolt keeper increases the resistance against disengagement between the bolt and the keeper, when the lock shaft is in its locked position. The resistance to disengagement has two components: one is the frictional resistance between the mutually engaging surfaces of the bolt and the keeper; the other is the underlapping support provided by the keeper relative to the bolt at their mutually engaging surfaces; and both components act to impede retraction of the bolt. Disengagement of the bolt and keeper requires two forces acting on the bolt, one in the retraction direction for the bolt and the other in the retraction direction for the sleeve. Attempts at forcing the bolt to disengage from the keeper without use of the key, i.e., tampering by pounding the top of the lock with a hammer, for example, will be frustrated by the two components resisting disengagement between the engageable surfaces of the bolt and keeper.

The present invention is particularly adaptable for use in an automobile anti-theft device.

The features of this invention which are believed to be novel are set forth with particularity in the appended claims. The invention together with its further objects and advantages thereof, may be best understood, however, by reference to the following description taken in conjunction with the accompanying drawings, in which like reference numerals identify the like elements in several figures.

DETAILED DESCRIPTION

Figure 1:
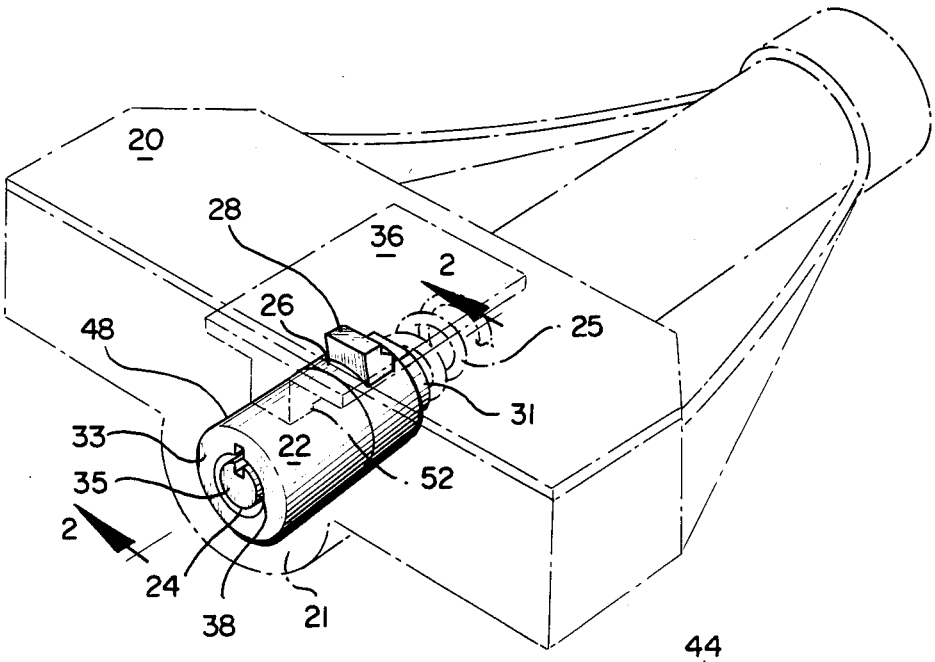
FIG. 1 is a schematic perspective, partially in phantom, illustrating an embodiment of a reciprocating cylinder lock mechanism in accordance with the present invention.

Referring initially to FIG. 1, there is illustrated an improved reciprocating cylinder lock mechanism in accordance with the present invention and which is useful in an automobile anti-theft security device. The mechanism comprises a lock casing 20 designed to fit easily under the dashboard of an automobile. However, the shape of the lock casing is not critical and may be appropriately designed to enable use of the lock of the present invention in other devices, e.g., vending machines.

Figure 2:
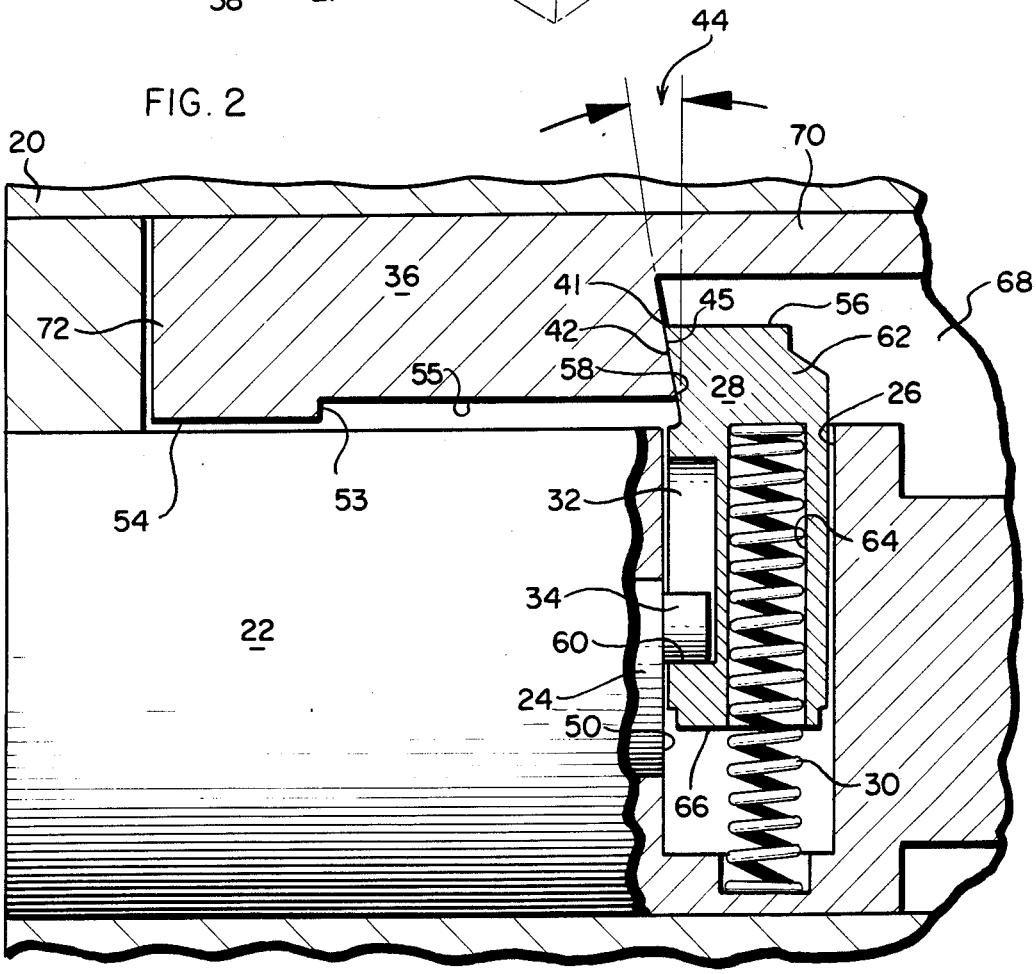
FIG. 2 is an enlarged sectional view, taken along line 2—2 of FIG. 1, showing the bolt and keeper portion of the lock mechanism in locked position.

Within casing 20 is a tubular sleeve 22 having inner and outer faces 31, 33 and mounted for axial movement in casing 20 from an extended, unlocked position to the retracted, locked position shown in FIGS. 1 and 2. Housed within sleeve 22 is a rotatable lock shaft 24. A spring 25 (FIG. 1) abuts inner face 31 of sleeve 22 to normally urge the sleeve into the extended, unlocked position. The outer sleeve face 33 and the outer face 35 of lock shaft 24 are designed to accept insertion of a key, which can effect rotational movement of lock shaft 24 to return the mechanism from a locked condition to an unlocked condition. In the unlocked condition, outer portion 48 of sleeve 22 and outer portion 38 of lock shaft 24 protrude longitudinally outwardly from face 21 of casing 20. Locking can be effected by depressing protruding outer portions 48, 38 of sleeve 22 and lock shaft 24 against the urging of spring 25 until faces 33, 35 of sleeve 22 and shaft 24, respectively, are flush with casing face 21, as will be described subsequently in more detail.

Referring now to FIG. 2, sleeve 22 has an opening or cavity 26 disposed transverse to the axis of sleeve 22 and located close to inner end 50 of lock shaft 24. Within sleeve cavity 26 is a bolt 28 mounted for movement through cavity 26 along a linear path transverse to the axis of sleeve 22, between a retracted, unlocked position and an extended, locked position (shown in FIG. 2). A spring 30 normally urges bolt 28 into the extended position but can be compressed to allow retraction of the bolt to an unlocked position.

A keeper 36 lies within casing 20 adjacent to and facing tubular sleeve 22. Different portions of keeper 36 engage bolt 28 in its locked and unlocked positions. Keeper 36 comprises a rectangular attachment portion 70 integral with a bolt engagement portion 72 which projects into the casing in the direction of sleeve 22. Bolt engagement portion 72 has a flat surface 54 which joins a perpendicular shoulder surface 53 which joins a perpendicular surface 55 parallel to surface 54. Surface 55 terminates at an edge 58 where it joins an inclined surface 45 which terminates at keeper attachment portion 70 with which inclined surface 45 forms an angle less than 90°.

Bolt 28 is a substantially elongated structure having a head portion 62, a shallow lateral recess 32 for cooperation with lock shaft 24, and a longitudinal recess 64 for receiving a spring 30 which urges bolt 28 toward keeper 36. Head portion 62 is designed to project into a cavity 68 in the casing adjacent to keeper surface 45 to engage keeper 36 in the locked condition. Head portion 62 comprises an inclined surface 42 parallel to keeper surface 45 and inclined toward the outer end of sleeve 22. Edge 41 of head 62 is formed by the junction of head surface 42 and head surface 56 which is parallel to keeper surface 55.

Lateral bolt recess 32 is embedded in the bolt side which faces lock shaft inner end 50 for receiving a lock pin 34 extending from lock shaft inner end 50 and eccentrically disposed with respect to the longitudinal axis of lock shaft 24. Longitudinal bolt recess 64 extends into bolt 28 from bolt surface 66 parallel and spaced apart from bolt head surface 56.

When the lock is in an unlocked condition, outer portions 48, 38 of sleeve 22 and shaft 24, respectively, protrude from casing face 21. Sleeve 22 and shaft 24 are retained within casing 20 against the urging of spring 25 by the engagement of keeper shoulder surface 53 with edge 41 on the bolt head portion, thereby preventing the sleeve, lock shaft and bolt from being removed from the casing. Spring 30 is compressed by the force exerted by keeper surface 55 on bolt head surface 56, and lock pin 34, which protrudes into bolt recess 32, is spaced above lower side 60 of bolt recess 32.

When sleeve outer face 33 and lock shaft outer face 35 are depressed flush against casing face 21, sleeve 22 moves axially inwardly against the urging of spring 25 until bolt edge 41 clears keeper edge 58. Bolt 28 is then urged through sleeve opening 26 by spring 30, until lower side 60 of bolt recess 32 contacts lock pin 34 (the condition illustrated in both FIGS. 1 and 2). Bolt 28 is thereby urged by spring 30 along a linear path through opening 26 in tubular sleeve 22 and into casing cavity 68 and engagement with keeper 36.

To return the lock to its unlocked condition, a key is inserted into outer sleeve face 33 and outer lock shaft face 35. Turning of the key causes lock shaft 24 to rotate approximately 180°. Rotation of lock shaft 24 urges lock pin 34 against bolt recess lower side 60, thereby compressing spring 30 and retracting bolt 28 from its locked position. When bolt edge 41 clears keeper edge 58, spring 25 urges sleeve 22 and shaft 24 toward casing face 21, whereby bolt head surface 56 contacts keeper surface 55. Once keeper surface 55 restrains spring 30 by contact with bolt surface 56, lock shaft 24 and lock pin 34 rotate 180° back to their original positions, and the lock is returned to unlocked condition.

When the bolt is in a locked position, the engagement between keeper 36 and bolt 28 imparts tamper-resistance to the lock mechanism. Mutually engaging surfaces 42 and 45 on bolt 28 and keeper 36, respectively, cooperate to increase the resistance of the bolt to dislodgement from its locked position by physical tampering with the lock mechanism. Surfaces 42 and 45 are disposed in non-parallel relation to the linear path of movement of bolt 28. Surface 42 of bolt 28 is inclined toward sleeve outer portion 48 and, in complementary fashion, surface 45 of keeper 36 is inclined parallel to bolt surface 42. It is desirable, for imparting maximal tamper resistance to the lock mechanism, that the mutually-engageable surfaces be inclined at an angle 44 of at least 7° from the linear path of movement of the bolt. An angle of less than 7° will allow the bolt to be dislodged from engagement with the keeper. Angles greater than 7° may be utilized, but are less practical than the optimum 7°.

As noted above, when bolt 28 is in its extended position, bolt surface 42 engages keeper surface 45. The resistance to dislodgement of these surfaces, disposed non-parallel to the linear path of movement of bolt 28, is considerably greater than the resistance between surfaces parallel to that linear path. One component of this resistance is friction. Additionally, the inclination of keeper surface 45 provides underlapping support to bolt 28 at the mutually engaging surfaces 45, 42. Bolt 28 therefore is held firmly in its locked position by two locking components which operate simultaneously to impede retraction of bolt 28 in the lock mechanism of the present invention.

Thus, physical tampering with the lock mechanism without a key can be defeated to a considerable extent. When bolt 28 is in its locked position, force applied to casing 20 above bolt 28 in an effort to dislodge bolt 28 and propel it downward through opening 26 will meet the counteracting two-component resistance of the mutually engageable surfaces 42 and 45 of bolt 28 and keeper 36. This improvement in the lock mechanism therefore enables the lock to defeat the most frequently used method of tampering with reciprocating cylinder lock mechanisms.

The foregoing detailed description has been given for clearness of understanding only, and no unnecessary limitations should be understood therefrom as modifications will be obvious to those skilled in the art.

What is claimed is:

1. A reciprocating cylinder lock mechanism comprising:

a tubular sleeve having inner and outer ends and a cavity therein extending transverse to the axis of said sleeve;

means mounting said sleeve for axial movement between a retracted, locked position and an extended, unlocked position;

means normally urging said sleeve toward said extended position;

a bolt;

means mounting said bolt for movement through said cavity along a linear path transverse to the axis of said sleeve, between a retracted, unlocked position and an extended, locked position;

said bolt having a surface inclined toward said outer end of said sleeve in non-parallel relation to the linear path of movement of said bolt;

means normally urging said bolt toward said extended, locked position;

a bolt keeper comprising means for engaging said bolt when the bolt is in its extended, locked position;

a rotatable locking shaft within said sleeve;

means responsive to the rotation of said shaft for retracting said bolt from its extended, locked position; and a surface on said keeper inclined parallel to and engageable with said surface on said bolt for providing underlapping support to said bolt to impart to said bolt resistance to dislodgement from its extended, locked position by physical tampering with said lock mechanism.

2. A reciprocating cylinder lock mechanism comprising:

a tubular sleeve having a cavity therein extending transverse to the axis of said sleeve;

means mounting said sleeve for axial movement between a retracted, locked position and an extended, unlocked position;

means normally urging said sleeve toward said extended position;

a bolt having a surface for engagement with a bolt keeper;

means mounting said bolt for movement through said cavity along a linear path transverse to the axis of said sleeve, between a retracted, unlocked position and an extended, locked position;

means normally urging said bolt toward said extended, locked position;

a bolt keeper comprising means for engaging said bolt when the bolt is in its extended, locked position;

a rotatable locking shaft within said sleeve;

means responsive to the rotation of said shaft for retracting said bolt from its extended, locked position; and a surface on said keeper engageable with said surface on said bolt, each of said surfaces inclined to define an angle of at least 7 degrees from the linear path of movement of said bolt, for providing underlapping support to said bolt to impart to said bolt resistance to dislodgement from its extended, locked position by physical tampering with said lock mechanism.

* * * * *